US012677918B2

(12) United States Patent
Xu

(10) Patent No.: US 12,677,918 B2
(45) Date of Patent: Jul. 14, 2026

(54) HIDDEN ELASTIC-LOADED HANDLE AND LUGGAGE CONTAINING THE SAME

(71) Applicant: Solite International Co., Ltd., Changhua City (TW)

(72) Inventor: Dao Wei Xu, Ruian City (CN)

(73) Assignee: SOLITE INTERNATIONAL CO., LTD., Changhua City (TW)

( * ) Notice: Subject to any disclaimer, the term of this patent is extended or adjusted under 35 U.S.C. 154(b) by 0 days.

(21) Appl. No.: 18/891,351

(22) Filed: Sep. 20, 2024

(65) Prior Publication Data

US 2025/0098831 A1 Mar. 27, 2025

(30) Foreign Application Priority Data

Sep. 22, 2023 (CN) ..... 202322593727.2

(51) Int. Cl.
*A45C 7/00* (2006.01)
*A45C 5/03* (2006.01)
*A45C 13/26* (2006.01)

(52) U.S. Cl.
CPC ..... *A45C 13/26* (2013.01); *A45C 5/03* (2013.01)

(58) Field of Classification Search
CPC ... A45C 13/26; A45C 13/262; A45C 2013/26; A45C 2013/267; A45C 2013/262; A45C 5/03; A45C 5/14; B62B 5/06; B62B 5/067; B62B 5/065; B25G 1/04; F16B 7/105; B25H 3/02
See application file for complete search history.

(56) References Cited

U.S. PATENT DOCUMENTS

| | | | | |
|---|---|---|---|---|
| 3,572,870 | A * | 3/1971 | Marks | A45C 13/22 220/757 |
| 4,928,800 | A * | 5/1990 | Green | A45C 13/262 190/115 |
| 6,226,834 | B1 * | 5/2001 | Lu | A45C 13/262 280/655 |
| 10,334,927 | B2 * | 7/2019 | Korey | A45C 13/03 |
| 10,837,197 | B2 * | 11/2020 | Kightlinger | E05B 5/003 |
| 2008/0078053 | A1 * | 4/2008 | Lu | A45C 13/262 16/113.1 |
| 2022/0240639 | A1 * | 8/2022 | Gooris | A45C 13/262 |

FOREIGN PATENT DOCUMENTS

| | | | |
|---|---|---|---|
| CN | 102144843 B | | 10/2013 |
| CN | 220916767 U | * | 5/2024 |

* cited by examiner

*Primary Examiner* — Chuck Y Mah
(74) *Attorney, Agent, or Firm* — MUNCY, GEISSLER, OLDS & LOWE, P.C.

(57) ABSTRACT

A hidden elastic-loaded handle comprises a handle base and a grip. The handle base includes a guiding portion along a pressing direction of the grip, which has a guiding surface and a limiting portion located on a path of the guiding surface. The grip includes a limiting member that moves along the path of the guiding surface and extends or retracts relative to the guiding surface. A first elastic member is provided within the handle base to drive the grip to bounce out relative to the handle base. When the grip is in a storage state, the limiting member is restricted below the limiting portion, and the first elastic member is compressed. By pressing the grip, the limiting member moves along the guiding surface below the limiting portion, causing the grip to bounce out to a usage state, and the limiting member is positioned above the limiting portion.

10 Claims, 5 Drawing Sheets

HIDDEN ELASTIC-LOADED HANDLE AND LUGGAGE CONTAINING THE SAME

BACKGROUND OF THE INVENTION

The present invention relates to the field of luggage technology, and more particularly to a hidden elastic-loaded handle and the luggage that comprises the handle.

Handles are typically installed on luggage, such as suitcases or briefcases. Currently, most handles are in the form of pull straps or pull rods, which are usually either directly fixed at both ends onto the carrier or embedded in a concealed manner within the wall of the carrier.

China Patent Application No. CN201010113068.2 discloses a handle that comprises a handle body. The handle body includes a gripping portion and a connecting portion that is bent or curved relative to the gripping portion. A reinforcing member is provided axially or longitudinally at the center of the connecting portion. The manufacturing method involves molding or processing a reinforcing member with a strength higher than that of the connecting portion, and then placing the reinforcing member axially or longitudinally at the center of the connecting portion.

However, the aforementioned structure requires continuous pressing of a button to operate the handle and pull it out for use. This design is suitable for suitcase pull rods or small luggage, but the need for continuous pressing is somewhat inconvenient.

SUMMARY OF THE INVENTION

An objective of the present invention is to overcome the shortcomings and deficiencies of the prior art and to provide a hidden elastic-loaded handle and luggage that comprises the handle.

To achieve the above objective, the present invention provides a hidden elastic-loaded handle, which comprises a handle base and a grip. An installation cavity is provided within the handle base. The grip has a storage state, in which the grip is hidden within the installation cavity, and a usage state, in which at least part of the grip extends out of the installation cavity to provide a position for a user to hold. A guiding portion is provided within the handle base along a pressing direction of the grip. The guiding portion has a guiding surface and a limiting portion located on a path of the guiding surface. The grip is provided with a limiting member movable along the path of the guiding surface to extend or retract relative to the guiding surface. A first elastic member is provided within the handle base and configured to drive the grip to bounce out relative to the handle base. When the grip is in the storage state, the limiting member is restricted below the limiting portion and the first elastic member is in a compressed state. When the grip is pressed, the limiting member moves along the guiding surface below the limiting portion until the limiting member is misaligned with the limiting portion, and when the grip is released, the first elastic member restores elastic deformation and causes the grip to bounce out and switch to the usage state, and the limiting member is positioned above the limiting portion.

In a preferred embodiment, the guiding surface includes a first mating surface located above the limiting portion, and a second mating surface located below the limiting portion. A notch is formed between the second mating surface and the limiting portion to restrict the limiting member.

In a preferred embodiment, the handle base is provided with a handle housing that matches a shape of the grip. At least one side of the handle housing is provided with a moving groove for the movement of the limiting member. An inner wall of one side of the moving groove forms the guiding surface. The side of the moving groove where the guiding surface is provided thereon forms the guiding portion. The guiding portion is integrally formed with the handle housing.

In a preferred embodiment, the grip includes a gripping portion and connecting portions formed by two ends of the gripping portion extending toward the installation cavity. The limiting member and the first elastic member are installed on the connecting portion. When the grip bounces out, the gripping portion provides the position for the user to hold.

In a preferred embodiment, a bar-shaped slot is provided on a side wall of the handle housing corresponding to the moving groove. A limiting rod is provided on a side wall of the connecting portion to be restricted within the bar-shaped slot.

In a preferred embodiment, an installation hole is provided at a bottom of the connecting portion. A protruding column is provided on the handle housing corresponding to the installation hole. The first elastic member is a spring, and the first elastic member is sleeved on the protruding column.

In a preferred embodiment, a second elastic member is provided on a side of the limiting member away from the guiding surface. The limiting member is in contact with the guiding surface under the action of the second elastic member.

In a preferred embodiment, a moving slot is provided on a side wall of the grip corresponding to the guiding surface. A sliding slot is provided at a bottom of the grip corresponding to the moving slot and communicates with moving slot. A sliding block is provided within the sliding slot. The limiting member is a guide rod, and the guide rod is connected to one end of the sliding block facing the moving slot. The guide rod is restricted within the moving slot. The second elastic member is provided on a side of the sliding block opposite to the guide rod, and two ends of the second elastic member are respectively in contact with the sliding block and the sliding slot.

In a preferred embodiment, a through hole is provided at the end of the sliding block away from the limiting member. An insertion rod is provided on an inner wall of the sliding slot corresponding to the through hole. The second elastic member is a spring. One end of the second elastic member is sleeved on the insertion rod, and the other end of the second elastic member is located within the through hole of the sliding block.

A luggage, comprises the above-mentioned hidden elastic-loaded handle.

To summarize, the present invention provides the hidden elastic-loaded handle, which is switchable between the storage state and the usage state of the grip through pressing. The design is ingenious, and the specific method is as follows: pressing the grip causes the limiting member to move along the path of the guiding surface. When the grip is in the storage state, the limiting member moves to the position below the limiting portion and abuts against the guiding surface under the action of the second elastic member, thereby preventing the grip from disengaging from the handle base under the action of the first elastic member. To switch the grip to the usage state, press the grip so that it continues to move along the guiding surface below the limiting portion until the limiting member is misaligned with the limiting portion. Upon releasing the grip, the first elastic member restores elastic deformation, causing the grip to bounce out, and the limiting member moving to the position above the limiting portion.

The present invention will become clearer in light of the following detailed description of illustrative embodiments of this invention described in connection with the drawings.

DETAILED DESCRIPTION OF THE INVENTION

Figure 1:
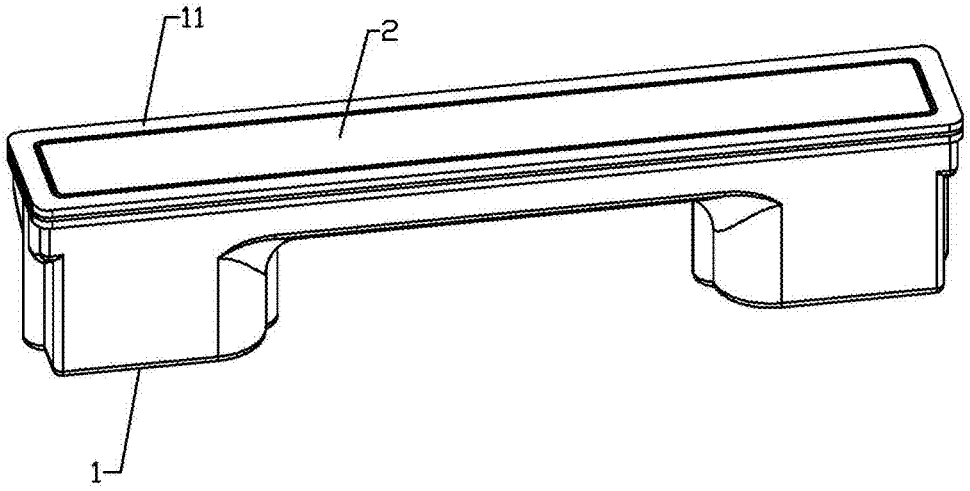
FIG. 1 is a schematic structural view of the present invention.
Figure 2:
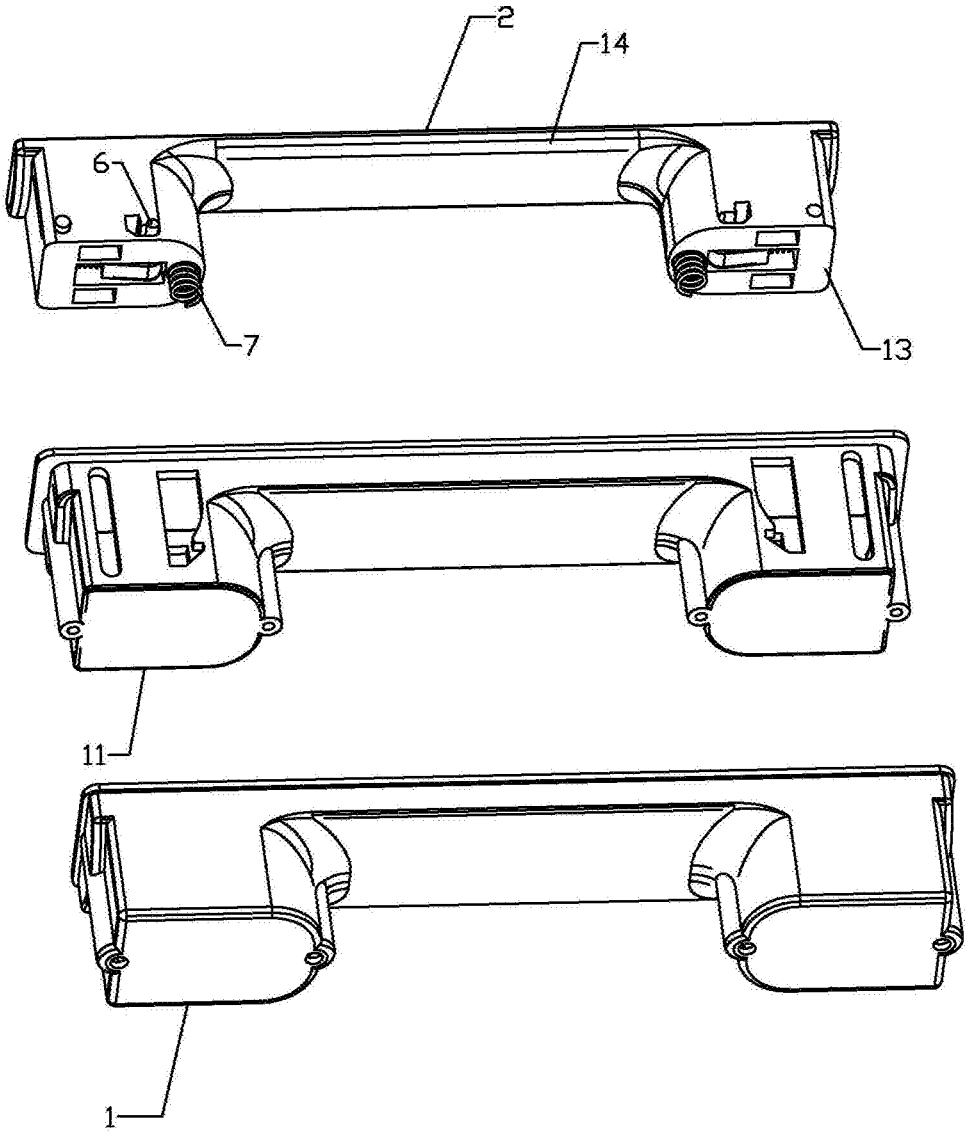
FIG. 2 is an exploded view of the present invention.
Figure 3:
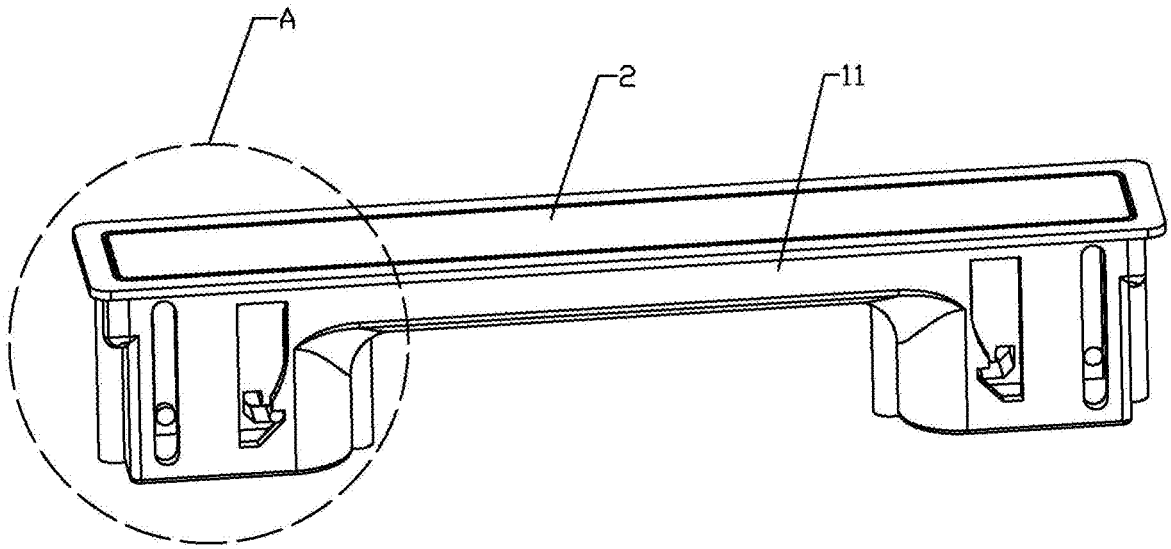
FIG. 3 is a schematic structural view showing the fit between the grip and the handle housing in the present invention.
Figure 4:
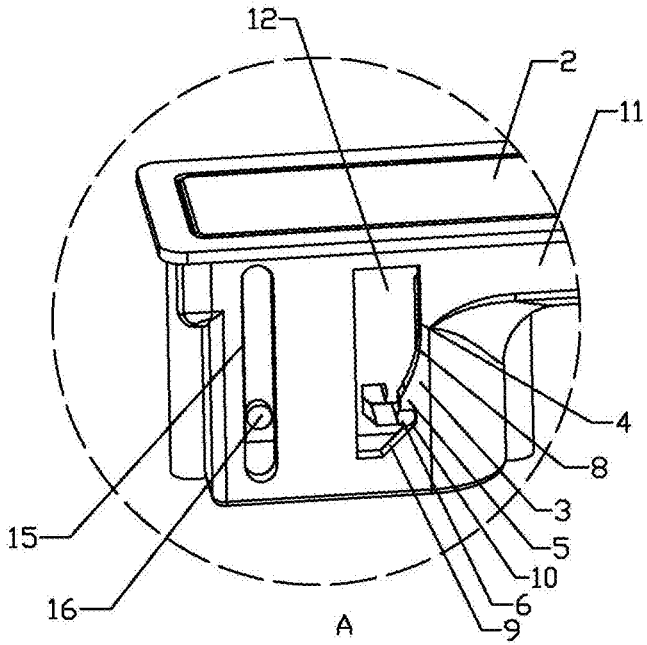
FIG. 4 is an enlarged view of part A in FIG. 3.
Figure 5:
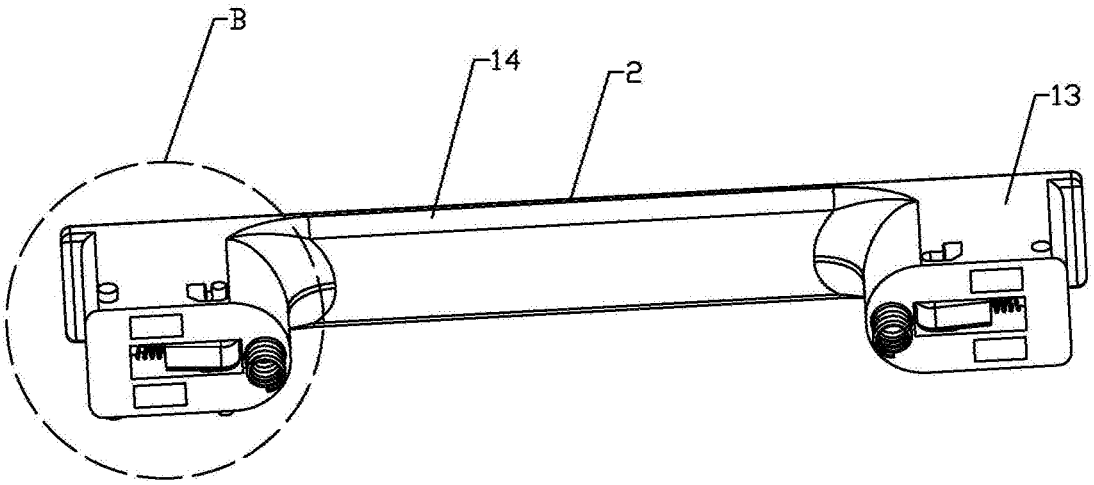
FIG. 5 is a schematic structural view of the grip in the present invention.
Figure 6:
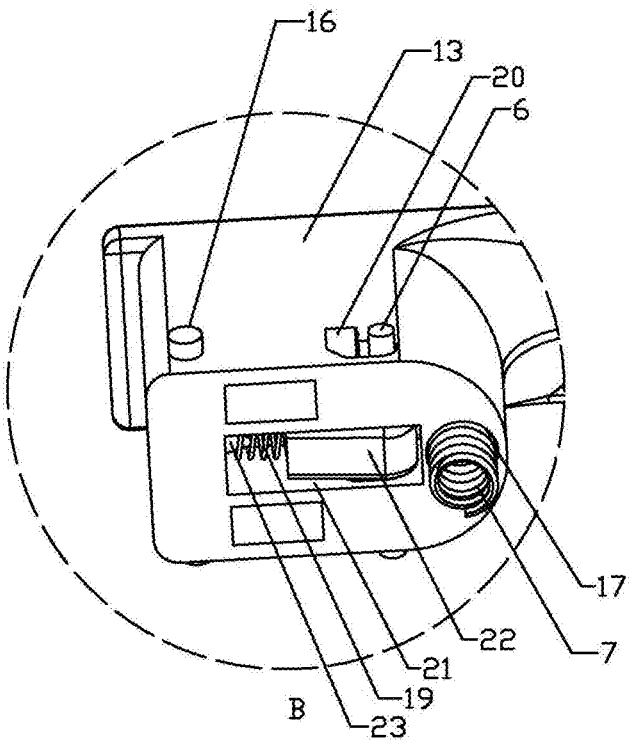
FIG. 6 is an enlarged view of part B in FIG. 5.
Figure 7:
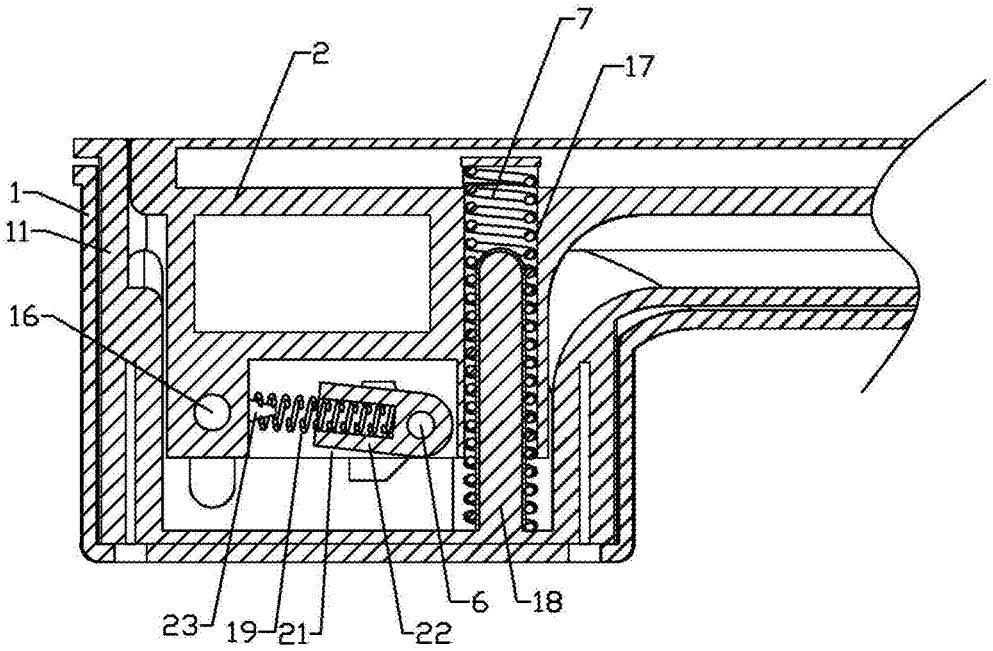
FIG. 7 is a partial cross sectional view of the present invention.

As shown in FIGS. 1 to 7, a hidden elastic-loaded handle comprises a handle base 1 and a grip 2. An installation cavity is provided within the handle base 1. The grip 2 has a storage state, in which it is hidden within the installation cavity, and a usage state, in which at least part of it extends out of the installation cavity to provide a position for the user to hold. A guiding portion 3 is provided within the handle base 1 along the pressing direction of the grip 2. The guiding portion 3 has a guiding surface 4 and a limiting portion 5 located on a path of the guiding surface 4. The grip 2 is provided with a limiting member 6 that is movable along the path of the guiding surface 4 and extends or retracts relative to the guiding surface 4. A first elastic member 7 is provided within the handle base 1 to drive the grip 2 to bounce out relative to the handle base 1. When the grip 2 is in the storage state, the limiting member 6 is restricted below the limiting portion 5 and the first elastic member 7 is in a compressed state. Pressing the grip 2 causes the limiting member 6 to move along the guiding surface 4 below the limiting portion 5 until it is misaligned with the limiting portion 5. Upon releasing the grip 2, the first elastic member 7 restores elastic deformation, causing the grip 2 to bounce out and switch to the usage state, with the limiting member 6 positioned above the limiting portion 5.

The guiding surface 4 includes a first mating surface 8 located above the limiting portion 5 and a second mating surface 9 located below the limiting portion 5. A notch 10 is formed between the second mating surface 9 and the limiting portion 5 to restrict the limiting member 6. The first mating surface 8 and the second mating surface 9 may be inclined surfaces or curved surfaces.

The handle base 1 is provided with a handle housing 11 that matches the shape of the grip 2. At least one side of the handle housing 11 is provided with a moving groove 12 for the movement of the limiting member 6, and an inner wall of one side of the moving groove 12 forms the guiding surface 4. The side of the moving groove 12 where the guiding surface 4 is provided thereon forms the guiding portion 3. The guiding portion 3 is integrally formed with the handle housing 11.

The grip 2 includes a gripping portion 14 and connecting portions 13 formed by two ends of the gripping portion 14 extending toward the installation cavity. The limiting member 6 and the first elastic member 7 are installed on the connecting portion 13. When the grip 2 bounces out, the gripping portion 14 provides the position for the user to hold. In this embodiment, the handle base 1 and the handle housing 11 are shaped to match the grip 2 and may be integrally or separately formed.

A bar-shaped slot 15 is provided on a side wall of the handle housing 11 corresponding to the moving groove 12. A limiting rod 16 is provided on a side wall of the connecting portion 13 to be restricted within the bar-shaped slot 15. The handle housing 11 is fixed within the handle base 1, and the limiting rod 16 is slidably fitted within the bar-shaped slot 15.

An installation hole 17 is provided at a bottom of the connecting portion 13. A protruding column 18 is provided on the handle housing 11 corresponding to the installation hole 17. The first elastic member 7 is a spring, and the first elastic member 7 is sleeved on the protruding column 18.

A second elastic member 19 is provided on a side of the limiting member 6 away from the guiding surface 4. The limiting member 6 is in contact with the guiding surface 4 under the action of the second elastic member 19.

A moving slot 20 is provided on a side wall of the grip 2 corresponding to the guiding surface 4. A sliding slot 21 is provided at a bottom of the grip 2 corresponding to the moving slot 20 and communicates with the moving slot 20. A sliding block 22 is provided within the sliding slot 21. The limiting member 6 is a guide rod, and the guide rod is connected to one end of the sliding block 22 facing the moving slot 20. The guide rod is restricted within the moving slot 20. The second elastic member 19 is provided on a side of the sliding block 22 opposite the guide rod. Two ends of the second elastic member 19 are respectively in contact with the sliding block 22 and the sliding slot 21. In this embodiment, the moving slot 20 is preferably L-shaped, but it can also be of other geometric shapes.

A through hole is provided at the end of the sliding block 22 away from the limiting member 6. An insertion rod 23 is provided on an inner wall of the sliding slot 21 corresponding to the through hole. The second elastic member 19 is a spring. One end of the second elastic member 19 is sleeved on the insertion rod 23, and the other end of the second elastic member 19 is located within the through hole of the sliding block 22.

Working principle and usage: The hidden elastic-loaded handle is switchable between the storage state and the usage state of the grip 2 through pressing. The design is ingenious, and the specific method is as follows: pressing the grip 2 causes the limiting member 6 to move along the path of the guiding surface 4. When the grip 2 is in the storage state, the limiting member 6 moves to the position below the limiting portion 5 and abuts against the guiding surface 4 under the action of the second elastic member 19, thereby preventing the grip 2 from disengaging from the handle base 1 under the action of the first elastic member 7. To switch the grip 2 to the usage state, press the grip 2 so that it continues to move along the guiding surface 4 below the limiting portion 5 until the limiting member 6 is misaligned with the limiting portion 5. Upon releasing the grip 2, the first elastic member 7 restores elastic deformation, causing the grip 2 to bounce out, and the limiting member 6 moving to the position above the limiting portion 5.

The hidden elastic-loaded handle in this embodiment can be applied to luggage, such as suitcases, briefcases, and the like.

Although specific embodiments have been illustrated and described, numerous modifications and variations are still possible without departing from the scope of the invention. The scope of the invention is limited by the accompanying claims.

During upward movement of the grip 2, the sliding block 22 moves upward along the sliding slot 21. Because the limiting member 6 is fixed to one end of the sliding block 22 and is directionally restricted by the moving slot 20, the limiting member 6 is forced to move together with the sliding block 22 and is thereby maintained in a retracted position relative to the guiding surface 4. The structural constraint provided by the sliding slot 21 prevents the second elastic member 19 from pushing the limiting member 6 toward the guiding surface 4 during upward movement, such that the limiting member 6 does not re-engage the limiting portion 5 while the grip 2 moves toward the usage state.

When the grip 2 returns from the usage state toward the storage state, the sliding block 22 moves downward along the sliding slot 21. As the sliding block 22 descends, the second elastic member 19 biases the limiting member 6 toward the guiding surface 4, allowing the limiting member 6 to re-enter a position below the limiting portion 5. Therefore, when the grip 2 reaches the storage state, the limiting member 6 is automatically repositioned below the limiting portion 5, enabling the grip 2 to be retained within the installation cavity.

The invention claimed is:

1. A hidden elastic-loaded handle comprising: a handle base and a grip, wherein an installation cavity is provided within the handle base, wherein the grip has a storage state, in which the grip is hidden within the installation cavity, and a usage state, in which at least part of the grip extends out of the installation cavity to provide a position for a user to hold, characterized in that:

a guiding portion is provided within the handle base along a pressing direction defined as a direction in which the grip moves toward the handle base within the installation cavity, wherein the guiding portion has a guiding surface and a limiting portion located on a path of the guiding surface, wherein the grip is provided with a limiting member movable along the path of the guiding surface to extend or retract relative to the guiding surface, wherein the limiting member is connected to a sliding block and directionally restricted by a moving slot such that the limiting member moves together with the sliding block along a moving direction of the grip, wherein a first elastic member is provided within the handle base and configured to drive the grip to bounce out relative to the handle base, wherein when the grip is in the storage state, the limiting member is restricted below the limiting portion and the first elastic member is in a compressed state, wherein when the grip is pressed, the limiting member moves along the guiding surface below the limiting portion until the limiting member is misaligned with the limiting portion, and wherein when the grip is released, the first elastic member restores elastic deformation and causes the grip to bounce out and switch to the usage state, and the limiting member is positioned above the limiting portion and held in a retracted position relative to the guiding surface by the movement of the sliding block until the grip reaches the usage state.

2. The hidden elastic-loaded handle as claimed in claim 1, wherein the guiding surface includes a first mating surface located above the limiting portion, and a second mating surface located below the limiting portion, and wherein a notch is formed between the second mating surface and the limiting portion to restrict the limiting member.

3. The hidden elastic-loaded handle as claimed in claim 2, wherein the handle base is provided with a handle housing that matches a shape of the grip, wherein at least one side of the handle housing is provided with a moving groove for the movement of the limiting member, and an inner wall of one side of the moving groove forms the guiding surface, wherein the side of the moving groove where the guiding surface is provided thereon forms the guiding portion, and wherein the guiding portion is integrally formed with the handle housing.

4. The hidden elastic-loaded handle as claimed in claim 3, wherein the grip includes a gripping portion and connecting portions formed by two ends of the gripping portion extending toward the installation cavity, wherein the limiting member and the first elastic member are installed on the connecting portion, and wherein when the grip bounces out, the gripping portion provides the position for the user to hold.

5. The hidden elastic-loaded handle as claimed in claim 4, wherein a bar-shaped slot is provided on a side wall of the handle housing corresponding to the moving groove, and wherein a limiting rod is provided on a side wall of the connecting portion to be restricted within the bar-shaped slot.

6. The hidden elastic-loaded handle as claimed in claim 4, wherein an installation hole is provided at a bottom of the connecting portion, wherein a protruding column is provided on the handle housing corresponding to the installation hole, wherein the first elastic member is a spring, and wherein the first elastic member is sleeved on the protruding column.

7. The hidden elastic-loaded handle as claimed in claim 1, wherein a second elastic member is provided on a side of the limiting member away from the guiding surface, and wherein the limiting member is in contact with the guiding surface under the action of the second elastic member.

8. The hidden elastic-loaded handle as claimed in claim 7, wherein the moving slot is provided on a side wall of the grip corresponding to the guiding surface, wherein a sliding slot is provided at a bottom of the grip corresponding to the moving slot and communicates with the moving slot, wherein the sliding block is provided within the sliding slot, wherein the limiting member is a guide rod, and the guide rod is connected to one end of the sliding block facing the moving slot, wherein the guide rod is restricted within the moving slot, wherein the second elastic member is provided on a side of the sliding block opposite to the guide rod, and wherein two ends of the second elastic member are respectively in contact with the sliding block and the sliding slot.

9. The hidden elastic-loaded handle as claimed in claim 8, wherein a through hole is provided at the end of the sliding block away from the limiting member, wherein an insertion rod is provided on an inner wall of the sliding slot corresponding to the through hole, wherein the second elastic member is a spring, and wherein one end of the second elastic member is sleeved on the insertion rod, and the other end of the second elastic member is located within the through hole of the sliding block.

10. A luggage, characterized in that: the luggage comprises a hidden elastic-loaded handle comprising: a handle base and a grip, wherein an installation cavity is provided within the handle base, wherein the grip has a storage state, in which the grip is hidden within the installation cavity, and a usage state, in which at least part of the grip extends out of the installation cavity to provide a position for a user to hold, wherein a guiding portion is provided within the handle base along a pressing direction defined as a direction in which the grip moves toward the handle base within the installation cavity, wherein the guiding portion has a guiding surface and a limiting portion located on a path of the guiding surface, wherein the grip is provided with a limiting member movable along the path of the guiding surface to extend or retract relative to the guiding surface, wherein the limiting member is connected to a sliding block and directionally restricted by a moving slot such that the limiting member moves together with the sliding block along a moving direction of the grip, wherein a first elastic member is provided within the handle base and configured to drive the grip to bounce out relative to the handle base, wherein when the grip is in the storage state, the limiting member is restricted below the limiting portion and the first elastic member is in a compressed state, wherein when the grip is pressed, the limiting member moves along the guiding surface below the limiting portion until the limiting member is misaligned with the limiting portion, and wherein when the grip is released, the first elastic member restores elastic deformation and causes the grip to bounce out and switch to the usage state, and the limiting member is positioned above the limiting portion and held in a retracted position relative to the guiding surface by the movement of the sliding block until the grip reaches the usage state.

* * * * *